US005568919A

United States Patent [19]

Detmers et al.

[11] Patent Number: 5,568,919

[45] Date of Patent: Oct. 29, 1996

[54] DELIVERY SYSTEM OF A SHEET-PROCESSING MACHINE

[75] Inventors: Andreas Detmers, Mauer; Michael Gieser, Oftersheim, both of Germany

[73] Assignee: Heidelberger Druckmaschinen AG, Heidelberg, Germany

[21] Appl. No.: 501,398

[22] Filed: Jul. 12, 1995

[30] Foreign Application Priority Data

Jul. 12, 1994 [DE] Germany ..... 44 24 483.5

[51] Int. Cl.[6] ..... B65H 29/68

[52] U.S. Cl. ..... 271/183; 271/204

[58] Field of Search ..... 271/182, 183, 271/204

[56] References Cited

U.S. PATENT DOCUMENTS

| | | | |
|---|---|---|---|
| 3,659,839 | 5/1972 | Baucke | 271/183 |
| 4,085,930 | 4/1978 | Weisgerber et al. . | |
| 5,259,608 | 11/1993 | Pollich | 271/183 |
| 5,263,415 | 11/1993 | Pollich | 271/183 |

FOREIGN PATENT DOCUMENTS

| | | | |
|---|---|---|---|
| 1917616 | 3/1973 | Germany . | |
| 2544566 | 4/1977 | Germany . | |
| 3724808 | 7/1988 | Germany | 271/204 |
| 0380167 | 9/1964 | Switzerland | 271/204 |
| 564322 | 9/1944 | United Kingdom . | |
| 2272892 | 6/1994 | United Kingdom | 271/204 |

*Primary Examiner*—H. Grant Skaggs

*Attorney, Agent, or Firm*—Herbert L. Lerner; Laurence A. Greenberg

[57] ABSTRACT

A delivery of a sheet-processing machine for transporting a sheet along a sheet-conveying path to a stacking device, includes a sheet braking device engaging, during operation, with an underside of a sheet and retarding it by suction belts or the like. A suction region is adjacent to and upstream of the sheet braking device. A suction device applies suction, in the suction region, to the underside of the sheet. A brake carriage carries the sheet braking device and the suction device and is displaceable between selective positions within a segment of the path. A stationary first guide device has a first sheet guide surface segment set back upstream from the sheet braking device. A second guide device has a guide element displaceable by the brake carriage and forming a second sheet guide surface segment between the sheet braking device and the first sheet guide surface segment. The second segment, together with the first segment, form a combined sheet guide surface having a telescopically variable length. The guide element assumes first and second relative positions with respect to the brake carriage in first and second operating modes of the delivery. In the first position, the guide element is upstream of the suction region, and the suction device is noncovered thereby and, in the second position, the guide element is upstream of the sheet braking device and the suction device is covered thereby.

7 Claims, 3 Drawing Sheets

1
2
3
4
5
5'
6
7
8
9
9
10
11
12
13
14
15
15
16
17
17
18
19
19
24

DELIVERY SYSTEM OF A SHEET-PROCESSING MACHINE

BACKGROUND OF THE INVENTION

FIELD OF THE INVENTION

The invention relates to a delivery system of a sheet-processing machine, more particularly, a printing press, for transporting a respective sheet in a conveying direction along a sheet-conveying path to a stacking device, the delivery having a sheet braking device engaging, during operation, with an underside of a respective sheet and retarding it by means of suction belts or the like; a suction region disposed adjacent to and upstream of the sheet braking device, as viewed in the sheet-conveying direction; a suction device for applying suction, in the suction region, to the underside of the respective sheet; a brake carriage carrying the sheet braking device and the suction device and being displaceable between selective positions within a segment of the sheet-conveying path; a stationary first guide device formed with a first sheet guide surface segment set back upstream from the sheet braking device, as viewed in the sheet-conveying direction; and a second guide device having a guide element displaceable by means of the brake carriage and forming a second sheet guide surface segment located between the sheet braking device and the first sheet guide surface segment, the second sheet guide surface segment, together with the first sheet guide surface segment, forming a combined sheet guide surface having a telescopically variable length.

A delivery system of the foregoing general type has become known heretofore from the published German Patent Document DE 25 44 566 A1 and is provided for non-smearing guidance of sheets printed in a first form and perfector printing process, i.e., on both sides thereof, by a sheet-fed printing press along a sheet-conveying path between a final printing unit of the sheet-fed printing press and a sheet braking device. In a consequent application of the basic principle of forming the sheet guide surface as free of gaps as possible, only one relatively narrow gap, which is limited or defined by a guide plate on the sides of the suction wheels provided to slow down the sheets, is provided between the suction wheels and an end of a sheet guide plate which faces towards them and is adjustable together therewith. During operation, negative pressure produced in accordance with the so-called injector principle prevails in this gap and applies suction to the underside of the respective sheet. In response to this suction, the trailing edge of a slowed-down leading sheet, in particular, is intended to dip out of the way downwardly in order to avert any collision with the leading edge of a yet unbraked trailing sheet. The faster the sheets follow one another, the more difficult it is for this downward out-of-the-way dip or movement to be achieved.

SUMMARY OF THE INVENTION

It is accordingly an object of the invention to provide a delivery system of a sheet-processing machine wherein, in a case of first form and perfector printing, at the usual machine speeds for that type of printing, nonsmearing sheet guidance is assured and, in a case of only one-sided printing at the usual increased machine speed therefor, uninterrupted sheet guidance along the sheet guide surface as far as the sheet braking device is assured.

With the foregoing and other objects in view, there is provided, in accordance with the invention, a delivery of a sheet-processing machine for transporting a respective sheet in a conveying direction along a sheet-conveying path to a stacking device, the delivery having a sheet braking device engaging, during operation, with an underside of a respective sheet and retarding it by means of suction belts or the like; a suction region disposed adjacent to and upstream of the sheet braking device, as viewed in the sheet-conveying direction; a suction device for applying suction, in the suction region, to the underside of the respective sheet; and a brake carriage carrying the sheet braking device and the suction device and being displaceable between selective positions within a segment of the sheet-conveying path; and comprising a stationary first guide device formed with a first sheet guide surface segment set back upstream from the sheet braking device, as viewed in the sheet-conveying direction; and a second guide device having a guide element displaceable by means of the brake carriage and forming a second sheet guide surface segment located between the sheet braking device and the first sheet guide surface segment, the second sheet guide surface segment, together with the first sheet guide surface segment, forming a combined sheet guide surface having a telescopically variable length, the guide element assuming a first relative position with respect to the brake carriage in a first operating mode of the delivery, and assuming a second relative position with respect to the brake carriage in a second operating mode of the delivery; in the first relative position, the guide element being disposed upstream of the suction region, as viewed in the sheet-conveying direction, and the suction device being noncovered thereby and, in the second relative position, the guide element being disposed upstream of the sheet braking device, as viewed in the sheet-conveying direction, and the suction device being covered thereby.

In accordance with another feature of the invention, the delivery includes, in the suction region, a sheet guide structure cooperating, in the first operating mode, with the underside of a respective sheet, the sheet guide structure being formed with respective alternating perforations and sheet guide surface portions cooperating with the underside of a respective sheet, and fans disposed beneath the sheet guide structure for generating suction during operation so as to produce a negative pressure in the perforations of the sheet guide structure.

In accordance with a further feature of the invention, the delivery includes at least one connector releasable without tools for connecting the guide element to the brake carriage, in the respective relative positions thereof with respect to the brake carriage.

In accordance with an added feature of the invention, the delivery includes an adjusting device for automatically shifting the guide element into a respective one of the two positions thereof relative to the brake carriage.

In accordance with an additional feature of the invention, the guide element is a flexible, substantially flat structure formed as a foil.

In accordance with an alternative feature of the invention, the guide element is a flexible, substantially flat structure formed of a length of fabric.

In accordance with a concomitant feature of the invention, the fabric length is coated.

According to the invention, the guide element assumes a first relative position with respect to the brake carriage in a first operating mode of the delivery system, and assumes a second relative position with respect to the brake carriage in a second operating mode of the delivery system; in the first relative position, the guide element is disposed following the suction region upstream with respect to the sheet-conveying direction, with the suction device released or uncovered and, in the second relative position, the guide element is likewise disposed following the sheet braking device upstream with respect to the sheet-conveying direction, with the suction device covered thereby. This has the advantage, in particular, that the suction region and the suction device operative therewithin can be constructed freely with respect to the suction which can thus be generated, without taking the second operating mode into consideration. The reason for this is that the suction region, in the case of the second operating mode of a delivery according to the invention, is covered by the guide element, so that no effect of the suction device on the sheets transported along the sheet guide surface occurs, even in a situation wherein the suction device is in operation. Both the suction region and the suction device can therefore be constructed optimally for the first operating mode. Within the scope of the invention, this first operating mode of the delivery is intended for the condition wherein the sheets transported along the sheet-conveying path are printed in a one-side or recto printing process. By comparison, the second operating mode is intended for the condition wherein the sheets are printed on both sides thereof, i.e., first-form and perfector or recto and verso printing.

Because of the freedom of construction or design of the suction region and suction device which is possible without having to consider this second operating mode, this region and this device can be in particular constructed in such a manner, in one application of the invention, that the delivery operated in the first mode, i.e., one-side or recto printing, assures uninterrupted sheet guidance particularly in the region around the sheet braking device, even whenever the machine speed is notably increased with respect to the currently conventional machine speeds for perfector or recto/verso printing. In the second operating mode of the delivery (two-side, perfector or recto/verso printing), smear-free sheet guidance is assured, at least at the machine speeds typically provided therefor, by the fact that the sheet guide surface can be disposed immediately upstream of the braking device, as viewed in the sheet-conveying direction. With the sheet guide surface disposed in this way, an air cushion which develops between the guide surface and a sheet, in particular, a sheet which is moved out of the way over the sheet guide surface by means of gripper devices, is then maintained up to the immediate vicinity of the sheet braking device. In the final analysis, this assures a non-smearing sheet guidance.

In an advantageous feature of the invention, the guide element, in a respective position thereof relative to the brake carriage, is connected to the brake carriage by connecting means which can be released without tools. This enables a simple manual resetting of the guide element.

In a further feature, an adjusting device is provided, by means of which the guide element can be shifted automatically into a respective one of the two relative positions thereof with respect to the brake carriage.

The hereinaforementioned option afforded by the invention of optimally constructing the suction region and the suction device without considering the second operating mode is expressed in an advantageous further feature, which is distinguished by the fact that, in the suction region, a sheet guide structure which, in the first operating mode, cooperates with the underside of a respective sheet is provided wherein perforations and sheet guide surface portions cooperating with the underside of a respective sheet alternate, and fans are disposed beneath the sheet guide structure, and the suction generated thereby during operation produces a negative pressure in the perforations of the sheet guide structure. The construction of the suction device by means of the fans disposed directly in the suction region proves in particular to be advantageous in many ways. With the fans, in the first operating mode, suction is exerted on a respective sheet within a wide suction region, with a relatively small power requirement. The result in the first operating mode of a delivery according to the invention, with relatively little energy consumption, is thus an especially effective suction action which, even at high machine speeds, tends to calms a respective sheet and tauten or stiffen it, and thus, particularly in the critical segment of the sheet-conveying path between the sheet guide surface and the sheet braking device assures uninterrupted sheet guidance.

Other features which are considered as characteristic for the invention are set forth in the appended claims.

Although the invention is illustrated and described herein as embodied in a delivery system of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
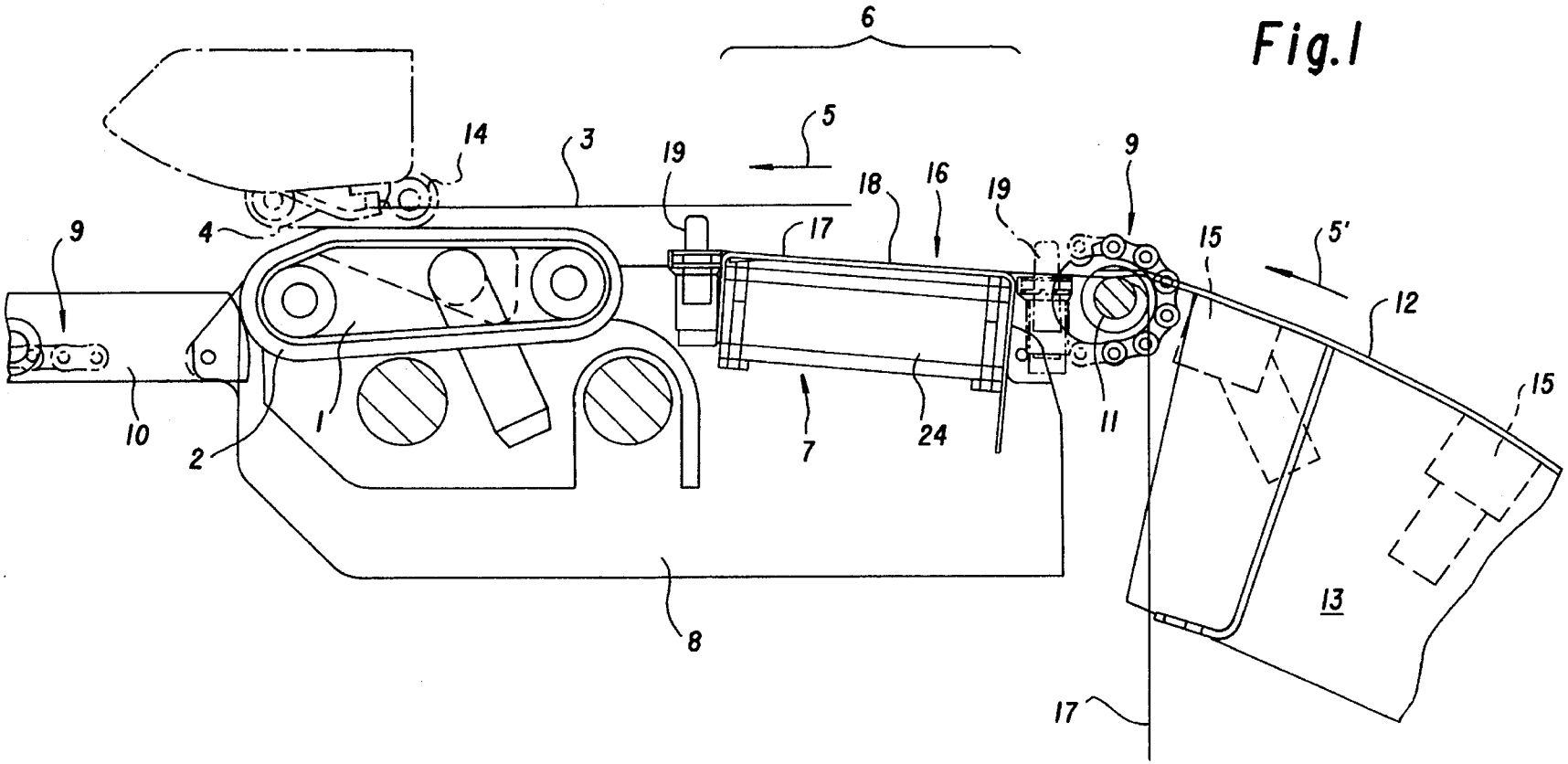
FIG. 1 is a simplified diagrammatic side elevational view of a segment of a delivery system of a sheet-processing machine which embodies the invention of the instant application.
Figure 2:
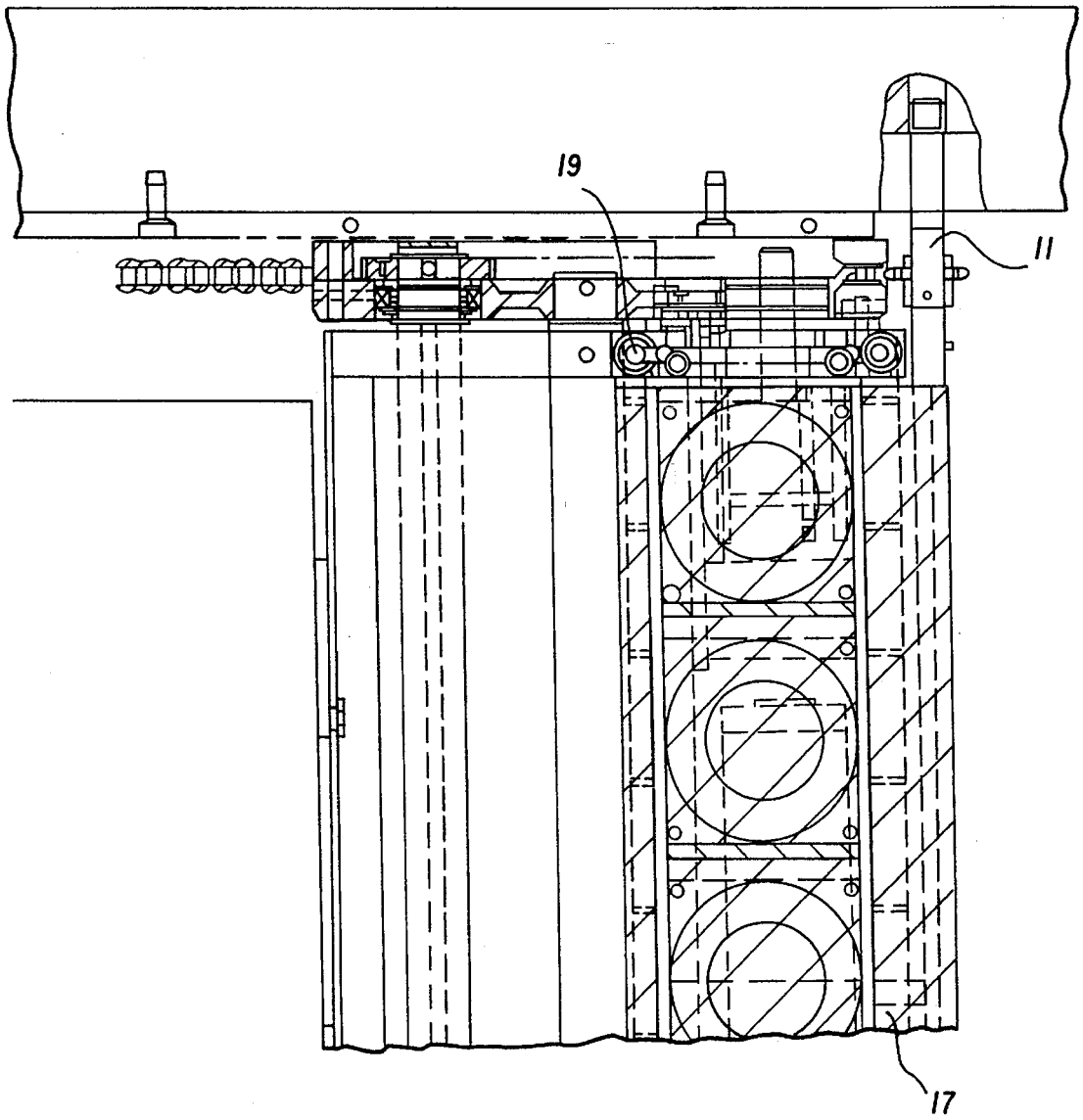
FIG. 2 is a fragmentary, much-enlarged plan view of FIG. 1.

Referring now to the drawings and, first, particularly to FIG. 1 thereof, there is shown therein an exemplary embodiment of a sheet braking device 1 according to the invention which, by means of suction belts 2, operatively engages an underside of a respective sheet 3 and slows it down. Only a front or leading portion of this sheet 3 is shown, the sheet being gripped in the vicinity of a front or leading edge thereof in a gripper device 4 and being transported thereby, in a sheet-conveying direction represented by the arrow 5, along a sheet-conveying path to a non-illustrated sheet-stacking device. In the idealized representation of the sheet 3 in FIG. 1 of the drawing, it is assumed that, in the position of the gripper device 4 shown relative to the sheet braking device 1, the leading portion of the sheet 3 located above the sheet braking device 1 does not yet rest on the suction belts 2 because of the existing gripper bite or closure, despite the suction exerted upon the sheet 3 by the sheet braking device 1. In this connection, it should be noted that, in the wherein the sheets 3 are printed on both sides thereof in a first form and perfecting operation, the suction belts 2 are conventionally adjusted to print-free or unprinted zones of the underside of the respective sheet 3. Adjacent the sheet braking device 1 and upstream thereof, as viewed in the sheet-conveying direction represented by the arrow 5, is a suction device 7 in a suction region 6 described in further detail hereinbelow. The sheet braking device 1 and the suction device 7 are carried by a brake carriage 8 which, in the exemplary embodiment shown in FIG. 1, is displaceable via an adjusting chain mechanism 9 between selective positions along a guide rail arrangement 10 within a segment of the sheet-conveying path. The displaceability of the brake carriage 8 is afforded so as to permit adjustment of the carriage 8 to a given format or size of the sheets 3, the carriage 8 being advanced to a respective one of the selective positions for effecting the adjustment to the given format or size by means of a corresponding rotation of a stationarily mounted chain wheel shaft 11 of the adjusting chain mechanism 9.

Set back from the sheet braking device 1, upstream with respect to the sheet-conveying direction 5, is a first sheet guide surface segment 12 formed on a stationarily mounted first guide device 13. In the vicinity of the portion of this sheet guide surface segment 12 shown in FIG. 1, the sheet-conveying direction is represented by an arrow 5'. As is apparent, the inclination of the sheet-conveying direction to the horizontal along the sheet-conveying path in a delivery completely changes. However, at each location along the sheet-conveying path, the sheet-conveying direction has a horizontal component which extends in the direction of a non-illustrated sheet-pile stacking region, which would be located beyond the left-hand side of FIG. 1. The respective sheet-conveying direction depends upon the course of the sheet-conveying path which, in turn, is determined by the course of revolving chains of which one chain link 14 is illustrated, and which transport the gripper devices 4. In the vicinity of the first guide device 13, the contour of the first sheet guide surface segment 12 formed thereon follows the aforementioned sheet-conveying path. Smear-free or non-smearing guidance of a sheet 3 in the vicinity of the first guide device 13 is achieved in a conventional manner by means of an air cushion which, when there is a suitable local spacing between the sheet-conveying path and the first sheet guide surface segment 12, represents a floating guidance for the sheet 3. In this connection, it has become known heretofore to stabilize this floating guidance by means of blast air, which emerges from the first sheet guide surface segment 12 via suitable nozzle devices 15. The first guide device 13 is therefore preferably equipped with such nozzle devices 15, specifically for the case wherein the sheets to be guided are printed on both sides, i.e, in a first-form and perfector printing process.

In the view of FIG. 1, the brake carriage 8 follows the first guide device 13 at a slight distance downstream therefrom, as viewed in the sheet-conveying direction. In practice, this is provided for the purpose of guiding and then stacking a pile of the sheets 3 which are of the maximum format or size for which the delivery is conceived. To guide and then stack sheets 3 of smaller size or format, the brake carriage 8 is essentially displaced downwardly a distance which is the difference in length between the maximum format and the smaller format. Particularly for such a case, the second guide device 16 is provided following downstream of the first guide device 13 in the sheet-conveying direction, the second guide device 16 having a guide element 17 which, in the exemplary embodiment of FIG. 1, is formed as a foil. The guide element 17 formed as the foil is placed over the chain wheel shaft 11, and an end portion of the guide element 17 directed towards the sheet braking device 1 is secured to the brake carriage 8, in a manner to be described in greater detail hereinbelow, so that the guide element 17 is displaceable together with the brake carriage 8. In this regard, the chain wheel shaft 11 is positioned so that a portion of the guide element 17, having an upper side and extending downstream from the shaft 11, forms a second sheet guide surface segment 18, which immediately follows the first sheet guide surface segment 12. This second sheet guide surface segment 18 is thus located between the first sheet guide surface segment 12 and the sheet braking device 1. The first and second sheet guide surface segments 12 and 18 together ultimately form a sheet guide surface which is telescopically variable in length by displacing the brake carriage 8, so that a continuous sheet guide surface is available also for guiding sheets 3 of a smaller format or size than the aforementioned maximum format, and thus also such sheets can be guided without smearing even if the underside of the sheets have been printed.

Figure 3:
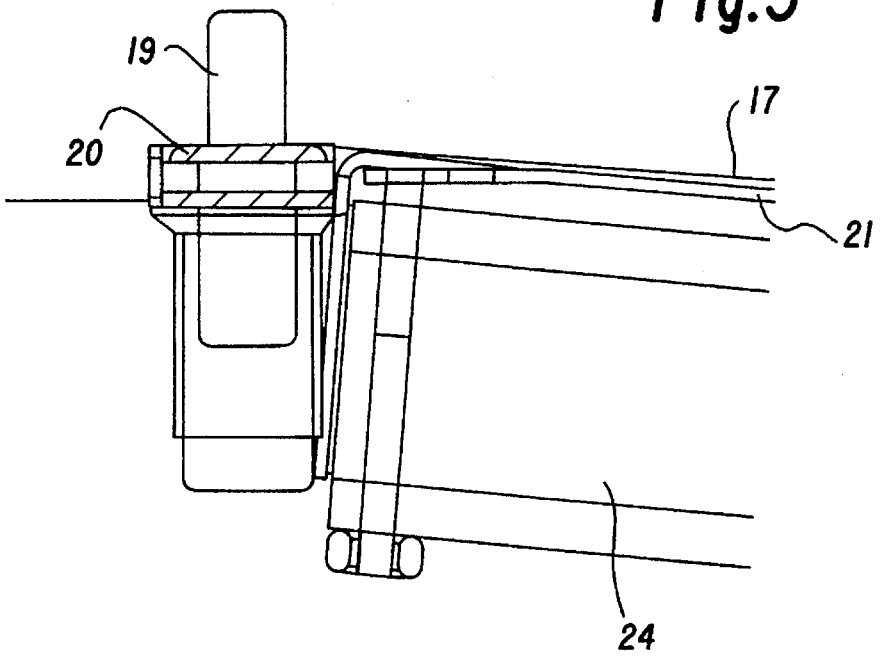
FIG. 3 is a fragmentary enlarged view of FIG. 1, showing a detail thereof.

To operate the delivery in the second operating mode, i.e., first-form and perfector or recto and verso printing, the end of the guide element 17 directed towards the sheet braking device 1 is secured to the brake carriage 8 between the suction region 6 and the sheet braking device 1. The guide element 17 is thus disposed upstream of the sheet braking device 1 in the sheet-conveying direction and covers the suction device 7 disposed in the suction region 6. Fastening thereof is achieved by connecting means 19, with which the guide element 17 can be connected to or disconnected from the brake carriage 8 without the aid of a tool. In the illustrated exemplary embodiment, commercially available Camloc pressure locks of the 15F series are used as the connecting means 19; these commercially available means need no further description and have not been shown in the drawing. The guide element 17 formed as a foil, at the end thereof directed towards the sheet braking device 1, is adhesively bonded and pinned to a reinforcing strip 20 (note FIG. 3), which extends over the width of the foil, and the connecting means 19 are associated in a mutual spaced relationship with a respective end of the reinforcing strip 20 so that they are located beyond or outside of a respective side edge of a sheet 3 which has been moved out of the way by the guide element 17.

When the end of the guide element 17 directed towards the sheet braking device 1 is secured between the suction region 6 and the sheet braking device 1, the guide element 17 is then in a herein referred to second relative position with respect to the brake carriage 8. This operating phase or condition is shown in FIG. 1 with the connecting means 19 represented in solid lines. In a position of the guide element 17 with respect to the brake carriage 8 which will referred to herein as the first relative position, the end of the foil which forms the guide element 17 and is provided with the aforementioned reinforcing strip 20 is connected to the brake carriage 8 upstream, following the suction region 6, so that in this case the suction region 6 is not covered by the guide element 17. This operating phase or condition is represented in FIG. 1 with the connecting means 19 shown in broken lines.

When the aforementioned pressure locks are used to secure the guide element 17 to the brake carriage 8, it proves to be especially simple, moreover, to convert the delivery from the first to the second operating mode thereof, and the reverse. To that end, retaining cams respectively corresponding to locking pins or plugs mounted on the ends of the reinforcing strip 20 are provided at first and second securing locations on the brake carriage 8, the first securing location following the suction region 6 upstream and the second securing location following the suction region 6 downstream, as viewed in the sheet-conveying direction. Conversion of the delivery from one of the two operating modes to the other then requires merely unplugging the closure pins or plugs disposed on the guide element 17 from the retaining cams at one of the fastening locations and plugging them into the retaining cams at the respective other fastening location on the brake carriage 8.

The guide element 17, formed in the exemplary embodiment as a foil, is also connected, at the end thereof remote from the reinforcing strip 20 and extending beyond the chain wheel or sprocket shaft 11, to a non-illustrated bar having a mass which serves the purpose of tautening or stiffening the foil. Instead of a foil, a length of fabric, for example, can also be used, it being preferably provided with a smooth coating, at least on the side which, in the installed position, is toward a respective sheet 3. In principle, any generally conceivable flexible flat structure suitable for maintaining an air cushion formed between it and a sheet 3 moved along above it can be used as the guide element 17.

Figure 4:
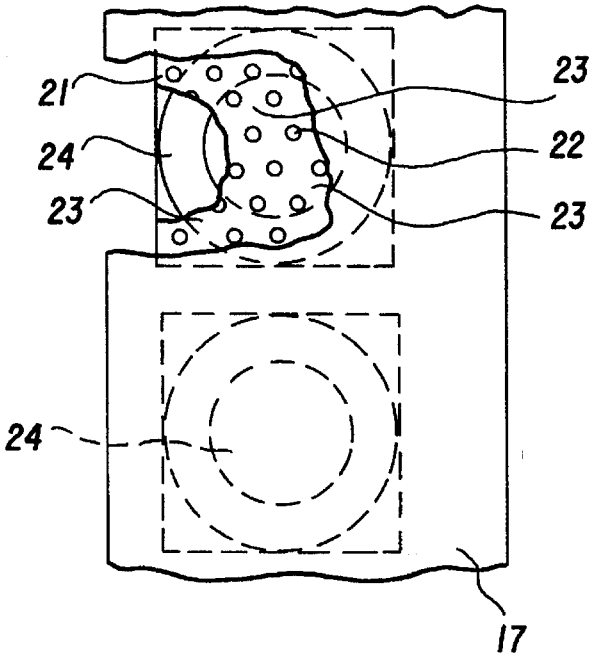
FIG. 4 is a fragmentary view of FIG. 2, showing a detail thereof.

In the second relative position of the guide element 17 shown in the drawings, the guide element 17 of the exemplary embodiment is moved away by a perforated plate disposed in the suction region 6 (note FIG. 4, particularly); in the first operating mode of the delivery, this perforated plate forms a sheet guide structure 21 which cooperates with the underside of a respective sheet 3, perforations 22, on the one hand, in the form of holes in the perforated plate, and sheet guide surface portions 23, on the other hand, in the form of webs between the holes of the perforated plate, alternating in the structure 21. However, the sheet guide structure 21 is not limited in its construction to a perforated plate. For example, a bar grate or other conceivable punctured or broken-through structures may be used, as long as they are suitable for supporting a sheet guided thereabove against a negative pressure prevailing in the perforations or break-throughs. Within the scope of the invention, this negative pressure is generated during operation by means of fans 24, which are located underneath the perforated plate. The fans 24 are disposed in a row extending transversely to the sheet-conveying direction and forming altogether the hereinaforementioned suction device 7.

With a view towards using the delivery in combination with a printing press equipped with a central control system, a non-illustrated adjusting device is provided within the scope of the invention, by means of which the guide element 17 is automatically shiftable into a respective one of the two relative locations with respect to the brake carriage 8. To this end, the reinforcing strip 20, for example, can be connected at the ends thereof to a carriage which is movable relative to the brake carriage 8 and which can be moved by means of suitable remotely controllable drive means, in such a manner according to the invention, that the guide element 17 is located in one of the relative locations thereof with respect to the brake carriage 8.

We claim:

1. Delivery of a sheet-processing machine for transporting a respective sheet in a conveying direction along a sheet-conveying path to a stacking device, the delivery having a sheet braking device engaging, during operation, with an underside of a respective sheet and retarding it by means of suction belts or the like; a suction region disposed adjacent to and upstream of the sheet braking device, as viewed in the sheet-conveying direction; a suction device for applying suction, in the suction region, to the underside of the respective sheet; and a brake carriage carrying the sheet braking device and the suction device and being displaceable between selective positions within a segment of the sheet-conveying path; and comprising a stationary first guide device formed with a first sheet guide surface segment set back upstream from the sheet braking device, as viewed in the sheet-conveying direction; and a second guide device having a guide element displaceable by means of the brake carriage and forming a second sheet guide surface segment located between the sheet braking device and said first sheet guide surface segment, said second sheet guide surface segment, together with said first sheet guide surface segment, forming a combined sheet guide surface having a telescopically variable length, said guide element assuming a first relative position with respect to the brake carriage in a first operating mode of the delivery, and assuming a second relative position with respect to the brake carriage in a second operating mode of the delivery; in said first relative position, said guide element being disposed upstream of the suction region, as viewed in the sheet-conveying direction, and the suction device being noncovered thereby and, in the second relative position, the guide element being disposed upstream of the sheet braking device, as viewed in the sheet-conveying direction, and the suction device being covered thereby.

2. The delivery according to claim 1, including, in the suction region, a sheet guide structure cooperating, in the first operating mode, with the underside of a respective sheet, said sheet guide structure being formed with respective alternating perforations and sheet guide surface portions cooperating with the underside of a respective sheet, and fans disposed beneath the sheet guide structure for generating suction during operation so as to produce a negative pressure in said perforations of said sheet guide structure.

3. Delivery according to claim 2, including at least one connector releasable without tools for connecting said guide element to the brake carriage, in the respective relative positions thereof with respect to the brake carriage.

4. Delivery according to claim 2, including an adjusting device for automatically shifting said guide element into a respective one of said two positions thereof relative to the brake carriage.

5. Delivery according to claim 2, wherein said guide element is a flexible, substantially flat structure formed as a foil.

6. Delivery according to claim 2, wherein said guide element is a flexible, substantially flat structure formed of a length of fabric.

7. Delivery according to claim 6, wherein said fabric length is coated.

* * * * *